United States Patent [19]

Rodowsky, Jr. et al.

[11] 4,300,262

[45] Nov. 17, 1981

[54] AIR-POWERED VACUUM CLEANER FLOOR TOOL

[75] Inventors: Stanley J. Rodowsky, Jr., Baltimore; Donald B. Morgan, Cambridge, both of Md.

[73] Assignee: Black & Decker Inc., Newark, Del.

[21] Appl. No.: 98,041

[22] Filed: Nov. 28, 1979

[51] Int. Cl.[3] ..... A47L 5/30

[52] U.S. Cl. ..... 15/387; 415/92

[58] Field of Search ..... 15/387, 377, 359; 415/92, 202, 203

[56] References Cited

U.S. PATENT DOCUMENTS

| | | | |
|---|---|---|---|
| 2,864,119 | 12/1958 | Crise | 15/359 X |
| 3,005,224 | 10/1961 | Magarian | 15/391 X |
| 3,044,100 | 7/1962 | Zaidan | 15/387 |
| 3,959,838 | 6/1976 | Hannah | 15/387 X |

*Primary Examiner*—Chris K. Moore

*Attorney, Agent, or Firm*—Harold Weinstein; Edward D. Murphy; Walter Ottesen

[57] ABSTRACT

An air-powered vacuum cleaner floor tool and an air turbine therefor are provided. The floor tool comprises a housing with a rotary agitator mounted on the bottom thereof, and a wand connector means mounted on the rear thereof and aligned with the longitudinal center of the housing. The wand connector is used for connecting the floor tool to a vacuum cleaner wand. The air-powered turbine motor has a turbine chamber and a rotor mounted on the housing, with the turbine chamber having an air inlet and an air outlet. The air inlet is aligned with the longitudinal center of the rotary agitator, and the air outlet is aligned with the longitudinal center of the housing and with the wand connector. The air outlet includes an outlet opening in the turbine chamber. The angle which is formed by the center line of the air inlet of the air-powered motor, and the center line of the outlet opening of the turbine chamber, is less than 55°. Further, the turbine rotor is rotatably mounted in the turbine chamber so that the smallest area between the outer periphery of the rotor and the wall of the turbine chamber is equal to substantially one-half of the area of the outlet opening of the turbine chamber.

8 Claims, 7 Drawing Figures

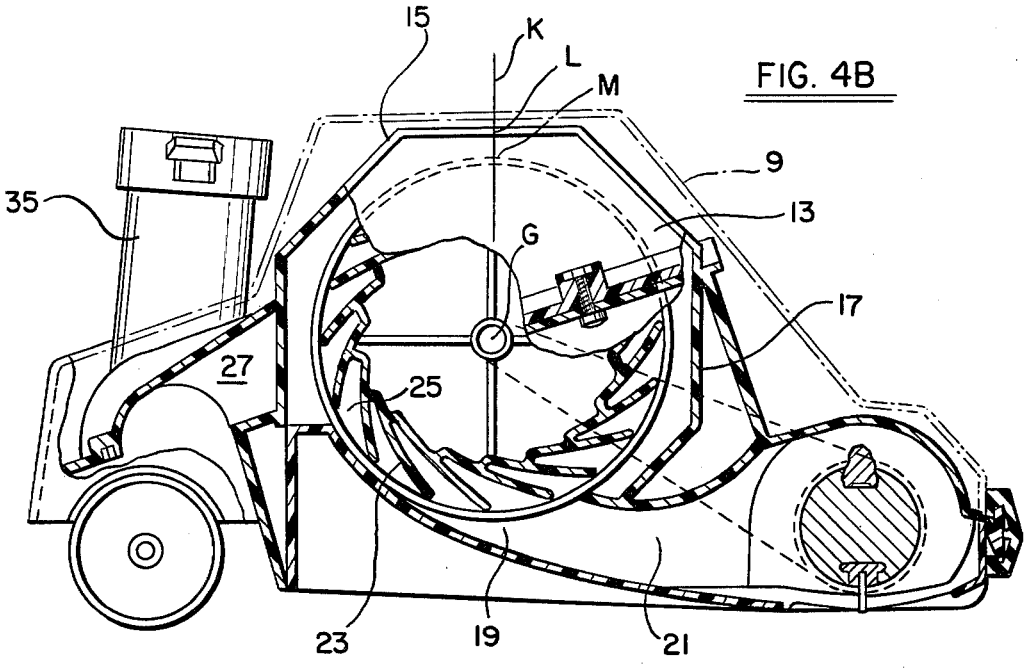
FIG. 4B
FIG. 4A
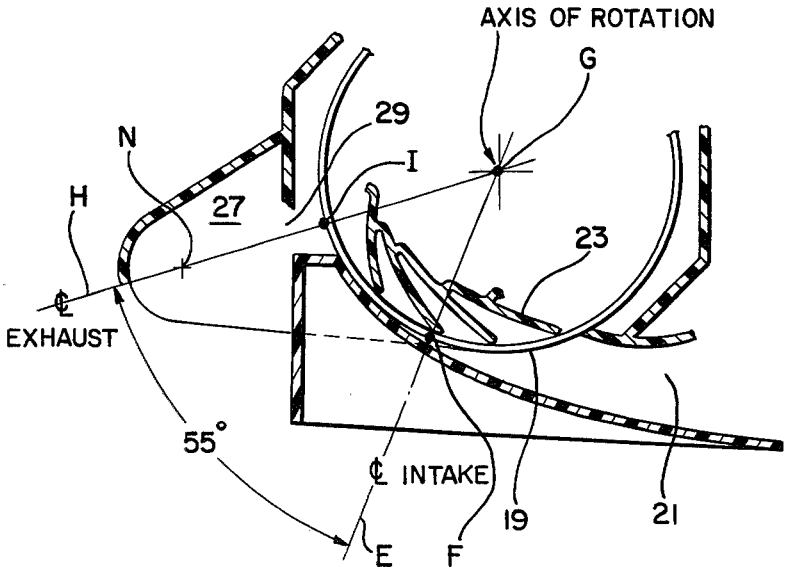

AIR-POWERED VACUUM CLEANER FLOOR TOOL

BACKGROUND OF THE INVENTION

1. Field of the Invention

This invention is related to an air-powered vacuum cleaner floor tool and an air-powered turbine motor therefor and, more particularly, to an air-powered vacuum cleaner floor tool and air-powered turbine motor therefor wherein the air inlet and air outlet of the floor tool are positioned with respect to other parts of the floor tool and with respect to each other so as to optimize the operation of the floor tool. Furthermore, the turbine chamber of the air-powered motor is formed with respect to the turbine rotor in order to minimize the size of the motor without reducing the efficiency of operation.

2. Description of the Prior Art

Magarian, U.S. Pat. No. 2,962,748; Magarian, U.S. Pat. No. 2,963,270 and Magarian, U.S. Pat. No. 3,005,224 are all directed to vacuum cleaner floor tools which have air-powered motors incorporated into the floor tool. Although these floor tools are of the same general type as the present invention, they do not include the features of the present invention which increase the efficiency of operation, reduce the size and enhance the ease of operation of the floor tool. In these prior art floor tools, the axis of the air inlet is not aligned with the longitudinal center of the rotary agitator in the floor tool and, therefore, the air flow through the opening in the floor tool around the agitator is not symmetrical. The lack of symmetrical air flow results in uneven cleaning.

These prior art floor tools also do not optimize the angle between the air inlet and the air outlet in order to facilitate operation of the floor tool without substantially decreasing the efficiency of the floor tool. Still further, these prior art floor tools do not minimize the size of the housing by maintaining the smallest area defined by the periphery of the turbine rotor and the walls of the turbine chamber equal to substantially one-half of the smallest area of the outlet opening of the turbine chamber.

Tschudy, U.S. Pat. No. 2,734,220, is directed to a vacuum cleaner in which the wand connector is offset with respect to the mouth of the exhaust duct of the floor tool. This patent does not, however, disclose or suggest an air-powered motor in combination with the floor tool, and thus suffers from the disadvantage that its cleaning efficiency is substantially less than that of a vacuum cleaner having an air-powered floor tool.

SUMMARY OF THE INVENTION

It is the primary object of the present invention to provide an air-powered vacuum cleaner floor tool and an air-powered turbine motor therefor wherein the air inlet and air outlet of the floor tool are positioned with respect to the other elements of the floor tool, and with respect to each other, in order to optimize the floor tool's operation.

It is another object of the present invention to provide an air-powered turbine motor wherein the turbine chamber surrounds the turbine rotor, and the smallest area between the circumferential periphery of the rotor and the walls of the chamber is equal to substantially one-half of the smallest area of the air outlet of the motor.

It is still another object of the present invention to provide an air-powered floor tool wherein the air inlet is aligned with the longitudinal center of a rotary agitator of the floor tool, and wherein the air outlet of the floor tool is aligned with the longitudinal center of the floor tool housing. The alignment of the air inlet with the longitudinal center of the rotary agitator enables the floor tool to draw air symmetrically from sides of the floor tool, thereby providing more uniform cleaning of the floor by the floor tool. The alignment of the air outlet of the floor tool with the longitudinal center of the housing enables a wand to be connected to the housing at the longitudinal center thereof, thereby eliminating torque about the longitudinal center of the housing when an operator pushes the floor tool along the floor, using a wand. This, of course, facilitates the use of the floor tool since there is no twisting effect when pushing the floor tool.

It is still a further object of the present invention to provide a vacuum cleaner floor tool and an air-powered turbine motor therefor wherein the angle formed between the center line through the air inlet opening and the center line through the air outlet opening of the turbine motor is less than 55°, while keeping the air outlet at or near the center of gravity of the floor tool. This feature of the present invention prevents the floor tool from rolling over on its front end during operation because the outlet, and thus the wand connector, is at or near the center of gravity, while not substantially reducing turbine efficiency because the angle between the center line of the air inlet and the center line of the air outlet is maintained at less than 55°.

It is still another object of the present invention to provide an air-powered vacuum cleaner floor tool and an air-powered turbine motor therefor wherein the turbine rotor is positioned within the turbine chamber such that the smallest area defined by the outer circumferential periphery of the rotor and the walls of the turbine chamber is equal to substantially one-half of the smallest area of the air outlet. This feature of the present invention minimizes the size of the air-powered motor, thereby reducing the size of the floor tool, and it also ensures good air flow characteristics through the turbine chamber with a minimum of air turbulence, without unduly restricting air flow, thereby enhancing turbine efficiency.

In particular, the present invention is directed to an air-powered vacuum cleaner floor tool and an air-turbine therefor. The floor tool comprises a housing with a rotary agitator mounted on the bottom thereof, and a wand connector means mounted on the rear thereof and aligned with the longitudinal center of the housing. The wand connector is used for connecting the floor tool to a vacuum cleaner wand. The air-powered turbine motor has a turbine chamber and a rotor mounted in the housing. The air inlet of the turbine chamber is aligned with the longitudinal center of the rotary agitator, and the air outlet of the floor tool is aligned with the longitudinal center of the housing and with the wand connector. The air outlet includes an outlet opening in the turbine chamber. The angle which is formed by the center line of the air inlet of the turbine, and the center line of the outlet opening of the turbine is less than 55°. Further, the turbine rotor is rotatably mounted in the turbine chamber so that the smallest area between the outer periphery of the rotor and the wall of the turbine chamber is equal to substantially one-half of the area of the outlet opening of the turbine chamber.

BRIEF DESCRIPTION OF THE DRAWINGS

FIG. 4A is a partial sectional view illustrating the vertical positional relationship of the air inlet and the air outlet of the air-powered turbine motor of the present invention.

FIG. 4B is a partial sectional view of the turbine motor of the present invention;

DETAILED DESCRIPTION OF THE PREFERRED EMBODIMENTS

Figure 1:
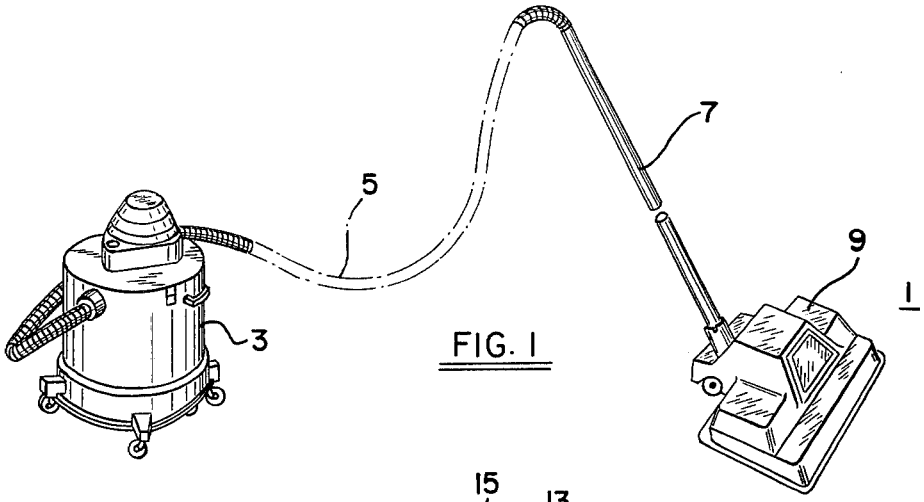
FIG. 1 is a perspective view of a vacuum cleaner having a floor tool of the present invention.
Figure 2:
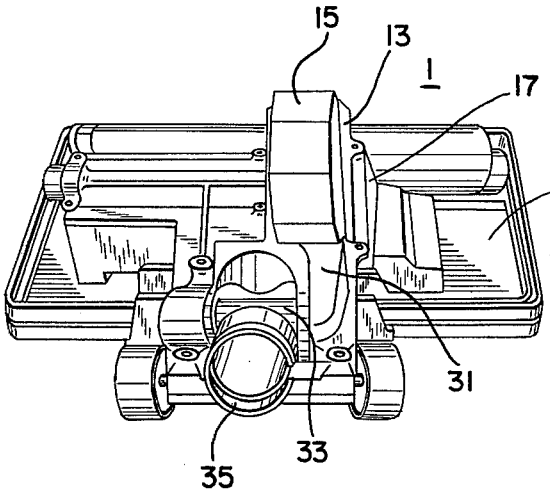
FIG. 2 is a perspective view of a vacuum cleaner floor tool of the present invention with the cover removed.
Figure 5:
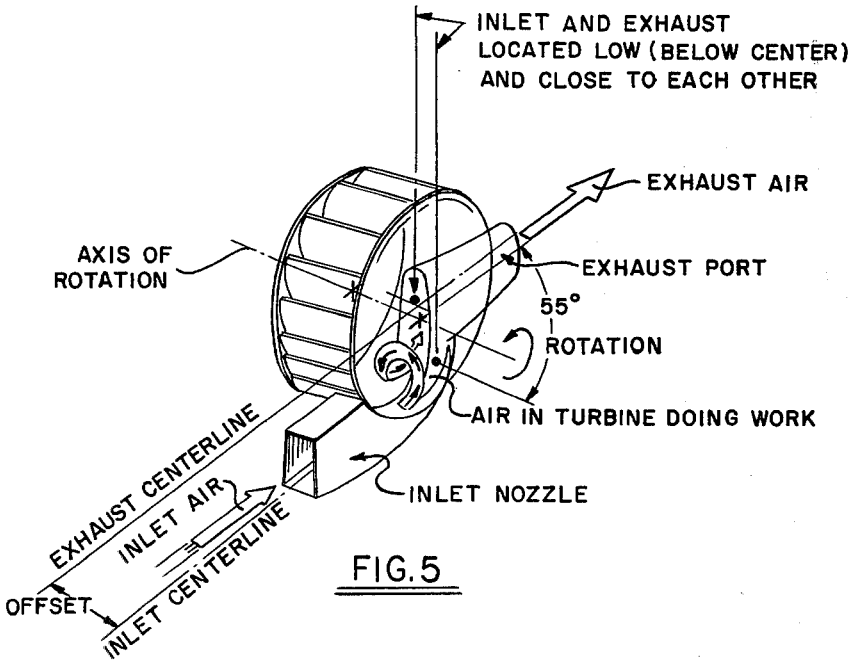
FIG. 5 is a diagram showing the positional relationship of the components of the air-powered motor of the present invention and the air flow therethrough.
Figure 3A:
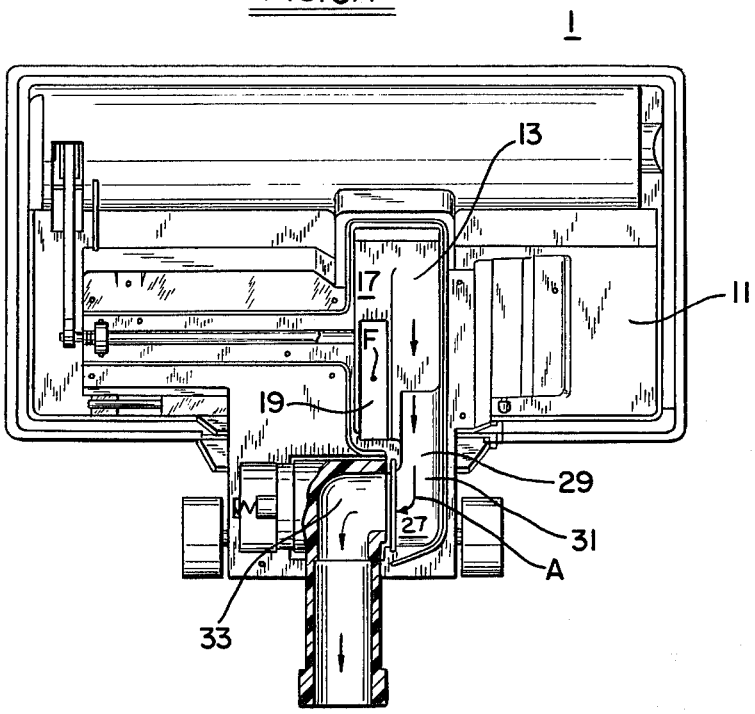
FIG. 3A is a plan view of a floor tool of the present invention with the upper portion of the floor tool and the turbine rotor removed.
Figure 3B:
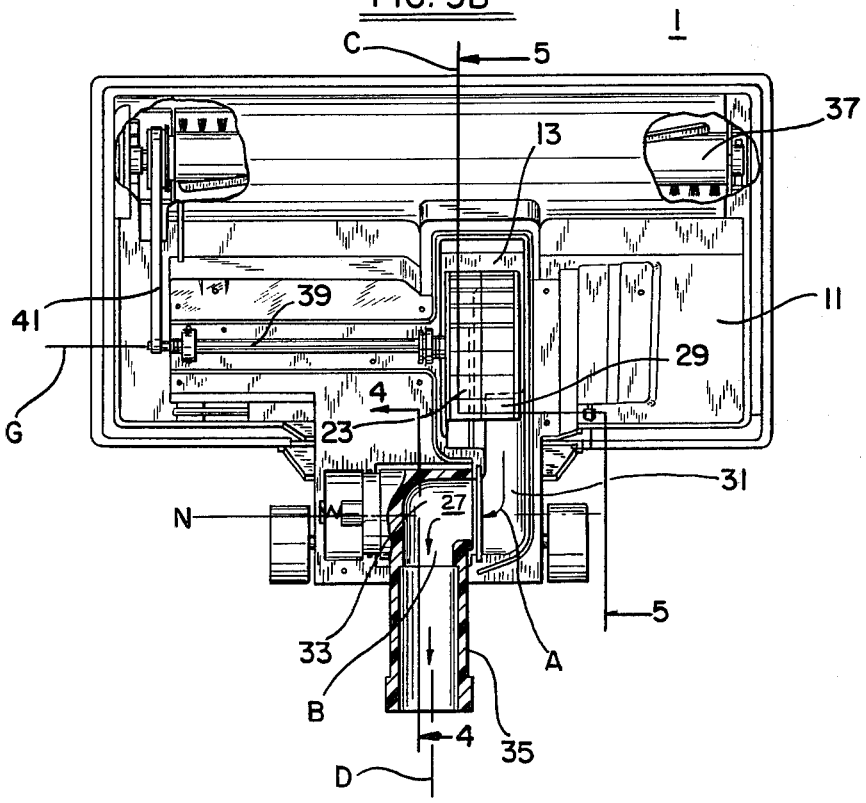
FIG. 3B is a plan view of a floor tool of the present invention with the upper portion of the housing removed.

Referring to FIG. 1, floor tool 1 is connected to vacuum cleaner 3 by means of hose 5 and wand 7. The floor tool 1 has a cover 9 which covers the floor tool housing. Referring to FIGS. 2, 3A and 3B, the floor tool 1 has a housing 11 which has a turbine chamber 13 formed therein.

The top of the turbine chamber 13 is formed by an upper housing portion 15 which is fixed to the lower housing portion 17. The lower housing portion 17 has an inlet opening 19 through which air is drawn from the bottom of the housing through a nozzle 21 which is shown in FIGS. 4A and 4B. Rotor 23 is rotatably mounted within the turbine chamber 13.

The air-powered turbine motor which is formed by the turbine chamber 13 and rotor 23 draws air through the nozzle 21 and inlet opening 19. The air drawn through the inlet opening 19 enters the turbine buckets 25 which causes the rotor to rotate. The air then exits from the turbine motor through an outlet structure generally indicated at 27. The outlet structure includes an outlet opening 29 in the turbine chamber, a first passage 31 in which the air flows in the direction of its exit from the turbine chamber, and is then turned 90°, as illustrated by arrow A. Continuous with first passage 31 is a second passage 33 in which the air flows in a direction perpendicular to the direction in which it exits from the turbine chamber, and is then turned through another 90° as illustrated by arrow B. The air flowing from the second passage is thus flowing parallel to the air from the turbine chamber, but is offset with respect thereto. A wand connector 35 is connected to the housing 11 and extends from the second passage 33.

The air-powered turbine motor is used to drive a rotary agitator 37 as shown in FIG. 3B. The turbine motor drives the rotary agitator by means of output shaft 39 and drive belt 41. The rotary agitator and coupling between the air-powered turbine and the rotary agitator are more completely described in application Ser. No. 072,080, filed Sept. 4, 1979, and assigned to the assignee of the invention in this application.

As can be seen, the rotary agitator 37 is not symmetrically positioned within the housing 11. Rather it is offset somewhat to the right. The center of the air inlet 19 is aligned with the longitudinal center of the rotary agitator 37. This feature of the present invention causes the air drawn through the floor tool by vacuum cleaner 3 to be drawn symmetrically with respect to the rotary agitator 37. This enhances the efficiency of the cleaning operation being performed by the floor tool. Axis C passes through the center of air inlet 19 and the longitudinal center of the rotary agitator 37 and illustrates the alignment of these two elements.

Another feature of the present invention is that the axis D, which passes through wand connector 35 and second passage 33 of the outlet structure 27, is aligned with the longitudinal center of the housing 11. Because of this alignment, when a wand is connected to the floor tool and an operator pushes on the wand, thereby moving the floor tool forward, there will be no twisting of the floor tool around its longitudinal center. Thus, the floor tool is easy to operate and is easy to handle. The outlet structure 27 of the floor tool of the present invention is significant because it enables the inlet of the turbine chamber to be aligned with the longitudinal center of the rotary agitator, while the outlet is aligned with the longitudinal center of the housing. Thus, the present invention incorporates both of these alignments which are each significant with regard to the operation of the floor tool.

As shown in FIG. 4A, the center line E of the inlet opening 19 is formed by the line which passes through point F, which is the longitudinal center of the inlet opening 19 and axis G, which is the axis of rotation of the turbine rotor 23. The center line H of the outlet opening 29 is formed by the line which passes through point I at the longitudinal center of the outlet opening, and axis G. The angle $\theta$ formed between center line E and center line H is less than 55°. Axis N, which is the axis of second passage 33, is made as close to the vertical center of gravity as possible in order to prevent tipping or rolling over of the floor tool onto its front end.

In order to reduce the size of the floor tool, the turbine chamber 13 should be made as small as possible without substantially reducing the efficiency of the turbine motor. This is accomplished by making the smallest area formed between the periphery of the turbine rotor 23 and the walls 15 or 17 of the turbine chamber positioned with respect to each other such that the smallest area is equal to substantially one-half of the smallest area of the outlet structure. Referring to FIG. 4B, the area formed in a plane through axis K, which is perpendicular to the plane of the paper between points L and M, is the smallest area between the periphery of the rotor and the walls of the turbine chamber. This area is equal to substantially one-half of the smallest area in the outlet opening 27. The size of the turbine chamber will not reduce the efficiency of the turbine. On the other hand, since this area is made as small as possible without reducing the efficiency, the size of the turbine chamber will be minimized and, therefore, the overall size of the floor tool can be made as small as possible without reducing its efficiency.

The present invention may be embodied in other specific forms without departing from the spirit or essential characteristic thereof. The presently disclosed embodiments are, therefore, to be considered in all respects as being illustrative and not restrictive. The scope of this invention is intended to be indicated by the appended claims, rather than the foregoing description, and all changes which come within the meaning and range of equivalency of the claims are to be embraced therein.

What is claimed:

1. An air-powered floor tool for a vacuum cleaner, said floor tool comprising:

(a) a housing having wheels mounted on the bottom thereof;

(b) a rotary agitator means mounted on the bottom of said housing;

(c) wand connector means mounted on the rear of said housing; and (d) an air-powered turbine motor having a turbine chamber and a rotor, mounted on said housing, said turbine chamber having an air inlet means and an air outlet means, wherein:

(i) said air inlet means comprises a nozzle having an inlet opening in the bottom of said housing and an outlet opening in the turbine chamber of said air-powered motor; and (ii) said outlet means comprises a first portion including an outlet opening in said turbine chamber and a second portion aligned with said wand connector means, a first passage coupled to said outlet opening for carrying air therefrom in the direction of ejection from said turbine chamber and then turning the flow therethrough 90°, said first passage including said first portion of said outlet means, a second passage continuous with, and perpendicular to, said first passage for carrying the flow of air from said first passage and turning the flow of air therethrough 90°, said second passage including said second portion, the outlet of said second passage being coupled to said wand connector means, wherein the air from said turbine motor flows from said turbine motor in a first direction, is turned 90° and flows in a second direction perpendicular to said first direction, and is then turned another 90° such that it flows parallel to said first direction but is offset therefrom, into said wand coupling means.

2. An air-powered floor tool as set forth in claim 1 wherein at least a portion of said turbine chamber is integrally formed on said housing.

3. An air-powered floor tool as set forth in claim 1 wherein said first passage is integral with said housing.

4. An air-powered floor tool as set forth in claim 1, wherein the axis of said second passage is positioned at or below the center of gravity of said floor tool.

5. An air-powered floor tool as set forth in any of claims 1, 2, 3 or 4 wherein the area defined by the outer circumferential periphery of said rotor and the walls of said turbine chamber in radial planes at any two points along the periphery of said motor is less than or equal to the area of said outlet means.

6. An air-powered floor tool for a vacuum cleaner, said floor tool comprising:

(a) a housing; and (b) an air-powered turbine motor, having a turbine chamber and a rotor, mounted on said housing, said turbine chamber having air inlet means and air outlet means, wherein the area defined by the outer circumferential periphery of said rotor and the walls of said turbine chamber in radial planes at any two points along the periphery of said motor is less than or equal to the area of said outlet means whereby said outlet means does not constrict the flow of air therethrough.

7. An air-powered floor tool as set forth in claim 6 wherein at least a portion of said turbine chamber is integrally formed on said housing.

8. An air-powered floor tool for a vacuum cleaner as claimed in claim 1, wherein said wand connector means is aligned with the longitudinal center of said housing for connecting said floor tool to a vacuum cleaner wand such that a pushing force on the wand is applied to the longitudinal center of said housing thereby avoiding twisting of said floor tool on a surface being cleaned, and wherein said air inlet means of said turbine chamber is aligned with the longitudinal center of said rotary agitator such that air is drawn into said air inlet means symmetrically about the longitudinal center of said rotary agitator.

* * * * *